United States Patent [19]

Mullins et al.

[11] Patent Number: 4,970,026

[45] Date of Patent: Nov. 13, 1990

[54] CORROSION INHIBITOR

[75] Inventors: Michael A. Mullins, Wayne; Robert W. Mueller, Riverdale; Peter A. Thomas, Lafayette, all of N.J.

[73] Assignee: Drew Chemical Corporation, Boonton, N.J.

[21] Appl. No.: 247,136

[22] Filed: Sep. 21, 1988

[51] Int. Cl.[5] ..... C23F 11/10

[52] U.S. Cl. ..... 252/389.62; 252/390; 252/391; 252/49.3; 252/49.7

[58] Field of Search ..... 252/392, 389.62, 391, 252/268, 49.3, 49.7

[56] References Cited

U.S. PATENT DOCUMENTS

| | | | |
|---|---|---|---|
| 2,602,760 | 7/1952 | Michel et al. | 252/392 |
| 2,869,995 | 1/1959 | Michel et al. | 252/392 |
| 2,908,648 | 10/1959 | Spivack et al. | 252/392 |
| 3,238,257 | 3/1966 | Ballard et al. | 252/392 |
| 3,556,994 | 1/1971 | Diery et al. | 252/392 |
| 3,717,433 | 2/1973 | Scherf et al. | 252/392 |
| 4,297,236 | 10/1981 | Diery et al. | 252/392 |
| 4,313,837 | 2/1982 | Vukasovich et al. | 252/392 |
| 4,323,476 | 4/1982 | Nelwerth et al. | 252/392 |
| 4,404,113 | 9/1983 | Peters et al. | 252/392 |
| 4,539,140 | 9/1985 | Quinlan | 252/392 |

OTHER PUBLICATIONS

Drew Corporation of Industrial Water Treatment, Drew Chemical Corporation, Boonton, N.J., Chaper 3, pp. 43–71.

ICI Americas, Inc. Product Data Sheet Tween 81, p. 2.

Hampshire Chemical Div. W. R. Grace & Co. Products Data Sheet Hampsoyl O, 3 pages.

American Hoeschst Corporation Product Data Sheet Bohrmittel Horechst, 2 pages.

American Hoechst Corporation Product Data Sheet Emulsogen Sth 1 page.

Hoechst Celanese Corporation Product Data Sheet Hoe S 3666, 1 page.

*Primary Examiner*—Robert L. Stoll

*Assistant Examiner*—Valerie Fee

*Attorney, Agent, or Firm*—Walter H. Schneider

[57] ABSTRACT

A corrosion inhibitor for ferrous and non-ferrous aqueous systems comprising any of (1) a naphthenic oil based sodium salt of a triethanolamine alkylsulfamido carboxylic acid, (2) a paraffinic oil based sodium salt of a triethanolamine alkylsulfamido carboxylic acid, (3) a sodium salt of an alkylsulfamido carboxylic acid, and (4) a synergistic mixture of any two of (1), (2) and (3).

2 Claims, No Drawings

CORROSION INHIBITOR

BACKGROUND OF THE INVENTION

1. Field of the Invention

The present invention relates to corrosion inhibition. More particularly, the present invention relates to corrosion inhibition in aqueous systems. Still more particularly, the present invention relates to a composition and method for controlling corrosion in aqueous systems.

2. Description of the Prior Art

Numerous chemical additives and combinations of additives have been proposed for inhibiting corrosion in cooling water systems in industrial manufacturing processes, commerical and institutional air conditioning systems, and the like. Among such additives may be mentioned such well known inorganic inhibitors as zinc, chromates, nitrites, nitrates, silicates, benzoates, polyphosphates, among others, all as set out in more detail in "Drew Principles of Industrial Water Treatment" published by Drew Chemical Corporation. Currently, various phosphonic acids and phosphonocarboxylic acids are favored, either alone or in combination with each other, with or without other known corrosion inhibitors.

While all of these known inorganic additives are beneficial to one degree or another in inhibiting corrosion in aqueous systems, there are also drawbacks to the use of some of these. For example, the use of phosphorous-containing additives can degrade, under certain conditions, to form deposits on the metallic surfaces for which protection is being provided, that diminish the effectiveness of the corrosion inhibitor. Some of the known additives, moreover, are environmentally unacceptable. Zinc salts and metal chromates, for instance, are highly toxic to many forms of aquatic life. This creates a disposal problem since discharge of waste water containing such inhibitors into natural waterways is restricted by Federal and State pollution standards and local water quality control standards. The use of polyphosphates also creates an environmental disposal problem because they degrade under certain conditions to orthophosphate which have a nutrient potential for algae growth. The discharge of waste water containing these products is, therefore, also regulated.

SUMMARY OF THE INVENTION

There has continued to remain, therefore, a need for an effective corrosion inhibitor for use in industrial aqueous systems which is both effective and environmentally acceptable. To this end, the present invention comprises an organic corrosion inhibitor, and a method for its use, that is surprisingly effective without operational disadvantages, such as unacceptable deposits, and which, at the same time, is environmentally acceptable. The present invention further comprises an inhibiting composition, and a method for its use, which takes the form of a synergistic mixture of two of such organic compounds. Finally, the corrosion inhibitor, either in the form of the organic compound according to this invention, or a synergistic mixture of such organic compounds, includes a surfactant which alone is ineffective as a corrosion inhibitor but which enhances the effectiveness of the corrosion inhibitor to which it is added.

DESCRIPTION OF THE PREFERRED EMBODIMENT

One embodiment of the corrosion inhibitor composition according to this invention comprises a member selected from (1) a naphthenic oil based sodium salt of a triethanolamine alkylsulfamido carboxylic acid (2) a paraffinic oil based sodium salt of a triethanolamine alkylsulfamido carboxylic acid, and (3) the sodium salt of an alkylsulfamido carboxylic acid, the alkyl group in each instance containing from 8–30 carbon atoms.

A second embodiment of the corrosion inhibitor composition according to this invention, and the preferred embodiment, comprises a mixture of any two of the above identified members. Such a mixture has surprisingly proved to have synergistic properties when used in a ratio of from 3:1–1:3, preferably in a ratio of 1:1.

A third embodiment of the corrosion inhibitor according to this invention comprises either one or the other of the first two embodiments in which has been incorporated at least one surfactant which is (1) a long chain fatty acid derivative of sarcosine such as cocoyl, lauroyl, or oleoyl sarcosine, or the sodium salts thereof, or (2) a condensation product of ethylene oxide and a fatty acid, e.g., polyoxyethylene sorbitan monolaurate palmitate, stearate or oleate in which the ethylene oxide repetition is about 20. This surfactant is incorporated in the corrosion inhibitor composition in a ratio to the inhibitor component or components of about 0.1–0.5:1, preferably about 0.2–0.4 parts by weight.

Notwithstanding that the corrosion inhibitors forming the composition of this invention are known individually to have been used as corrosion inhibitors in metal working fluids, such as mineral oils, their efficacy in the protection of metal surfaces against corrosion in an entirely different environment, i.e., an aqueous, alkaline cooling system, is unexpected. Particularly surprising is the synergistic corrosion inhibition obtained when using a mixture of the inhibitors in such an aqueous alkaline environment.

The composition of the present invention is equally effective in both heat and non-heat cooling water transfer systems, to which it is added in an amount effective to essentially eliminate the corrosion of the metal parts. This amount will vary depending upon the system and will be influenced by the area of the exposed metal surface area; processing conditions, e.g., pH, temperature, water; etc. In general, the composition, when comprising a single component without an added surfactant, will be used in an amount of 50-500 ppm of water in the system, usually about 100-300 ppm. The concentration will usually be the same when the composition is used in the form of a mixture of components, notwithstanding that improved results over those obtained with a single component can be obtained because of the synergistic characteristics of the mixture.

The composition is normally employed with an aqueous vehicle in which the component or components are present in a concentration of about 1–80%, usually about 5–40%. Alternatively, the components in their liquid form can be added directly to the aqueous system.

The composition of this invention may also include other water treatment components such as, defoamers, dispersants, biocides, etc. A particularly desirable optional component is a polymeric anti-scalant. For this purpose, any of various vinyl polymers may be employed, a preferred polymer being a polyacrylamide offered by American Cyanamid Company under the trademark Cyanamer P-70 and having a molecular weight of approximately 1000.

The corrosion inhibiting composition is particularly effective in inhibiting corrosion of ferrous containing metals, especially mild steel. The composition, therefore, has particularly applicability in cooling water systems using cycled water in which acid is not used to reduce the pH. The composition is equally effective, however, in non-ferrous systems, e.g., those containing admiralty brass.

The present invention is further described in the following Example in which all parts are by weight unless otherwise indicated.

EXAMPLE I

The effectiveness of the composition of this invention in controlling corrosion was determined by suspending mild steel specimens in an aqueous environment designed to simulate the cooling water cycled in the towers of a cooling water system. Testing was done under both heat transfer and non-heat transfer conditions using a standard hard water at a pH of 7.0–7.5. Tests were conducted against a control for 72 hours after which the degree of corrosion was measured in mils of metal surface loss per year (mpy).

Tables I and II show the results obtained when using the composition of this invention when comprising a single component.

TABLE I

| | (Non-Heat Transfer) | |
|---|---|---|
| Inhibitor | PPM | Corrosion Rate (mpy) |
| Control | | >80 |
| 1* | 50 | 42.1 |
| 1 | 100 | 12.1 |
| 1 | 200 | 1.1 |
| 2** | 50 | 20.2 |
| 2 | 100 | 10.9 |
| 2 | 200 | 1.4 |

*A naphthenic oil based sodium triethanolamine salt of an alkylsulfamido carboxylic acid available under the trademark Bohrmittel Hoechst from American Hoechst Corp.

**A sodium salt of an alkylsulfamido carboxylic acid available under the trademark Emulsogen STH from American Hoechst Corp.

TABLE II

| | (Heat Transfer) | |
|---|---|---|
| Inhibitor | PPM | Corrosion Rate (mpy) |
| Control | | >100 |
| 1 | 50 | 28.7 |
| 1 | 200 | 0.5 |
| 2 | 50 | 36.2 |
| 2 | 200 | 0.8 |
| 3*** | 50 | 49.2 |
| 3 | 200 | 0.3 |

***A paraffinic oil based triethanolamine salt of an alkylsulfamido carboxylic acid available under the trademark HOE-S-3666 from American Hoechst Corp.

EXAMPLE II

The surfactant additives for the composition of this invention were tested separately for corrosion inhibition. The ineffectiveness of these additives as corrosion inhibitors is shown by the results recorded in the following Table III.

TABLE III

| | (Heat Transfer) | |
|---|---|---|
| Additive | PPM | Corrosion Rate (mpy) |
| Control | | >100 |
| 4[2] | 10 | 77.0 |
| 4/5[3] | 50/50 | 9.4 |

[2]Cocoyl sarcosine available under the trademark Hamposyl-C from W. R. Grace & Co.

[3]POE (20) sorbitan monooleate available under the trademark Tween 80 from ICI Americas Inc.

EXAMPLE III

The results recorded in the following Table IV show the synergism of the composiiton according to this invention and the effect of the surfactant additive on both the syneristic composition and the composition comprising a single component.

TABLE IV

| | (Heat Transfer) | | | | |
|---|---|---|---|---|---|
| | Product (PPM) | | | | Corrosion Rate |
| 1 | 2 | 3 | 4 | 5 | (mpy) |
| Control | | | | | >100 |
| 50 | | | | | 28.7 |
| | 50 | | | | 36.2 |
| | | 50 | | | 49.2 |
| 50 | 50 | | | | 3.3 |
| 50 | | 50 | | | 0.4 |
| | 50 | 50 | | | 0.2 |
| 25 | 25 | | | | 12.7 |
| 25 | 25 | | | 5.0 | 2.0 |
| | | 50 | 10 | | 1.0 |
| | | 50 | | 10 | 3.1 |

Reference in the disclosure to details of the specific embodiments described is not intended to restrict the scope of the appended claims which themselves recite those features regarded as essential to the invention.

We claim:

1. An aqueous corrosion inhibiting composition for use in inhibiting corrosion of metallic surfaces in an alkaline cooling water system which consists of about 1–80% by weight of (A) a member selected from (1) a naphthenic oil based sodium salt of a triethanolamine alkylsulfamido carboxylic acid; (2) a paraffinic oil based sodium salt of a triethanolamine alkylsulfamido carboxylic acid; (3) a sodium salt of an alkylsulfamido carboxylic acid; and (4) a mixture consisting of two members selected from (1), (2) and (3), the alkyl in each instance having from 8-30 carbons, and (B) a surfactant selected from (a) cocoyl, lauroyl and oleoyl sarcosine or a sodium salt thereof, and (b) a condensation product selected from polyoxyethylene sorbitan monolaurate, palmitate, stearate or oleate in which the ethylene oxide repetition is about 20, said surfactant and said member being in a weight ratio of about 0.1–0.5/1.0.

2. A composition according to claim 1 in which said member is a paraffinic oil-based sodium salt of a triethanolamine alkylsulfamido carboxylic acid present in about 5–40% by weight and said surfactant is cocoyl sarcosine present in a weight ratio with said member of about 0.2–0.4/1.0.

* * * * *